US006352216B1

(12) United States Patent
Coats

(10) Patent No.: US 6,352,216 B1
(45) Date of Patent: Mar. 5, 2002

(54) COILED TUBING HANDLING SYSTEM AND METHODS

(75) Inventor: E. Alan Coats, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/502,317

(22) Filed: Feb. 11, 2000

(51) Int. Cl.[7] ..... B65H 75/14; B65H 75/22; E21B 19/22

(52) U.S. Cl. ..... 242/608.4; 242/609.2; 242/610.5; 242/614

(58) Field of Search ..... 242/608.4, 608, 242/608.2, 608.3, 608.5, 608.6, 609.2, 609, 609.1, 609.3, 609.4, 610.5, 614, 614.1, 604, 613.2, 613.3, 407.1; 166/77.2, 77.3, 384, 385

(56) References Cited

U.S. PATENT DOCUMENTS

| | | | | |
|---|---|---|---|---|
| 3,841,407 | A | 10/1974 | Bozeman | 166/315 |
| 4,148,445 | A | 4/1979 | Reynolds et al. | |
| 4,213,724 | A | 7/1980 | Holderness | 414/133 |
| 4,454,999 | A | 6/1984 | Woodruff | |
| 4,649,954 | A | 3/1987 | Dunwoody | 137/355.17 |
| 5,289,845 | A | 3/1994 | Sipos et al. | 137/355.27 |
| 5,469,916 | A | 11/1995 | Sas-Jaworsky et al. | 166/64 |
| 5,738,173 | A | 4/1998 | Burge et al. | 166/385 |
| 5,865,392 | A | 2/1999 | Blount et al. | 242/597.2 |
| 5,908,049 | A | 6/1999 | Williams et al. | 138/125 |
| 5,913,337 | A | 6/1999 | Williams et al. | 138/125 |
| 5,988,702 | A | 11/1999 | Sas-Jaworsky | 285/249 |

FOREIGN PATENT DOCUMENTS

EP 0911483 A2 4/1999

OTHER PUBLICATIONS

Alexander Sas–Jaworsky, et al, "Development of Composite Coiled Tubing for Oilfield Services", SPE 26536, 1–15, (1993).

*Primary Examiner*—John M. Jillions
(74) *Attorney, Agent, or Firm*—Conley, Rose & Tayon, P.C.

(57) ABSTRACT

A reel configured to store an extended length of composite coiled tubing has a plurality of sections. In one embodiment, the reel has a drum and pair of detachable sidewalls. Each side wall includes a plurality of flanges. In another embodiment, the reel includes a radial splitline that defines substantially identical securably matable sections. Preferably, the reel can store at least 20,000 feet of composite coiled tubing.

17 Claims, 6 Drawing Sheets

COILED TUBING HANDLING SYSTEM AND METHODS

CROSS-REFERENCE TO RELATED APPLICATIONS

Not Applicable.

STATEMENT REGARDING FEDERALLY SPONSORED RESEARCH OR DEVELOPMENT

Not Applicable.

1. Field of the Invention

The present invention relates to devices for handling coiled tubing for oil drilling operations. More particularly, the present invention relates to reels that have a capacity to hold extended lengths of coiled tubing. Still more particularly, the present invention relates to sectional transportable reels that have a capacity to hold extended lengths of coiled tubing.

2. Description of the Related Art

Coiled tubing, as currently deployed in the oilfield industry, generally includes small diameter cylindrical tubing made of metal or composites that have a relatively thin cross sectional thickness. Coiled tubing is typically much more flexible and much lighter than conventional drill string. These characteristics of coiled tubing have led to its use in various well operations. Coiled tubing is introduced into the oil or gas well bore through wellhead control equipment to perform various tasks during the exploration, drilling, production, and workover of a well. For example, coiled tubing is routinely utilized to inject gas or other fluids into the well bore, inflate or activate bridges and packers, transport well logging tools downhole, perform remedial cementing and clean-out operations in the bore, and to deliver drilling tools downhole. The flexible, lightweight nature of coiled tubing makes it particularly useful in deviated well bores.

Typically, coiled tubing is introduced into the oil or gas well bore through wellhead control equipment. A conventional handling system for coiled tubing can include a reel assembly, a gooseneck, and a tubing injector head. The reel assembly includes a rotating reel for storing coiled tubing, a cradle for supporting the reel, a drive motor, and a rotary coupling. During operation, the tubing injector head draws coiled tubing stored on the reel and injects the coiled tubing into a wellhead. The drive motor rotates the reel to pay out the coiled tubing and the gooseneck directs the coil tubing into the injector head. Often, fluids are pumped through the coiled tubing during operations. The rotary coupling provides an interface between the reel assembly and to a fluid line from a pump. Such arrangements and equipment for coiled tubing are well known in the art.

While prior art coiled tubing handling systems are satisfactory for coiled tubing made of metals such as steel, these systems do not accommodate the relatively long lengths of drill or working strings achievable with coiled tubing made of composites. Such extended lengths of composite coiled tubing strings are possible because composite coiled tubing is significantly lighter than steel coiled tubing. In fact, composite coiled tubing can be manufactured to have neutral buoyancy in drilling mud. With composite coiled tubing effectively floating in the drilling mud, downhole tools, such as tractors, need only overcome frictional forces in order to tow the composite coiled tubing through a well bore. This characteristic of composites markedly increases the operational reach of composite coiled tubing. Thus, composite coiled tubing can allow well completions to depths of 20,000 feet or more, depths previously not easily achieved by other methods.

Moreover, composites are highly resistant to fatigue failure caused by "bending events," a mode of failure that is often a concern with steel coiled tubing. At least three bending events may occur before newly manufactured coiled tubing enters a well bore: unbending when the coiled tubing is first unspooled from the reel, bending when travelling over a gooseneck, and unbending upon entry into an injector. Such accumulation of bending events can seriously undermine the integrity of steel coiled tubing and pose a threat to personnel and rig operations. Accordingly, steel coiled tubing is usually retired from service after only a few trips into a well bore. However, composite coiled tubing is largely unaffected by such bending events and can remain in service for a much longer period of time.

Hence, systems utilizing composite coiled tubing can be safely and cost-effectively used to drill and explore deeper and longer oil wells than previously possible with conventional drilling systems. Moreover, completed but unproductive wells may be reworked to improve hydrocarbon recovery. Thus, composite coiled tubing systems can allow drilling operations into territories that have been inaccessible in the past and thereby further maximize recovery of fossil fuels.

However, these dramatic improvements in drilling operations require handling systems that can efficiently and cost-effectively deploy extended lengths of composite coiled tubing. In prior art coiled tubing handling systems, the reel assembly is generally the largest single component of the coiled tubing unit. The size of the reel assembly is often indirectly limited by various governmental codes and regulations. For example, on many domestic highway routes, additional fees are levied on tractor-trailer combinations that exceed a specified weight or size limitation. Further, because offshore platform space is at a premium, many drilling companies place strict requirements on the amount and size of equipment permitted on the rig at any given time. The size and load carrying limits of available barges or transport ships may also limit the physical size of the reel.

Nonetheless, a reel having a large storage capacity provides operational efficiencies. For example, two reels storing 12,000 feet of coiled tubing each can be deployed more efficiently than three reels storing 8,000 feet each. One reason for this efficiency is that a two reel configuration eliminates a reel change-out. That is, by carrying longer lengths at one time, large coiled tubing reels benefit drilling companies because they reduce the number of work stoppages required to insert a new reel of tubing into the work string. Because rig time is very expensive, it is often cost-effective to minimize the elapsed time for tubing deployment.

For these reasons, a coiled tubing system that both maximizes the length of tubing that can be deployed and minimizes the physical size of the unit is desired. Because composite coiled tubing can be deployed in lengths vastly greater than has been possible with steel coiled tubing, there is a need for a transportable reel that can store large quantities of coiled tubing.

In summary, while oil and gas recovery operations could greatly benefit from coil handling systems capable of handling long lengths of coiled tubing, the prior art does not disclose such handling systems.

SUMMARY OF THE PRESENT INVENTION

The present invention overcomes the deficiencies of the prior art by including the design of a reel assembly that can be disassembled for transportation. Such a reel assembly may be deployed more efficiently than prior art designs. One benefit of this design is that the empty reel assemblies can be removed from the coiled tubing platform without disturbing the operation of the remaining reel assemblies in order to provide room on the platform for the remaining reel assemblies to operate without obstruction. This design allows empty reels to be packaged and shipped in a manner that is more efficient than what was possible under the limitations of the prior art.

Other objects and advantages of the present invention will be apparent in the following description.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Figure 1:
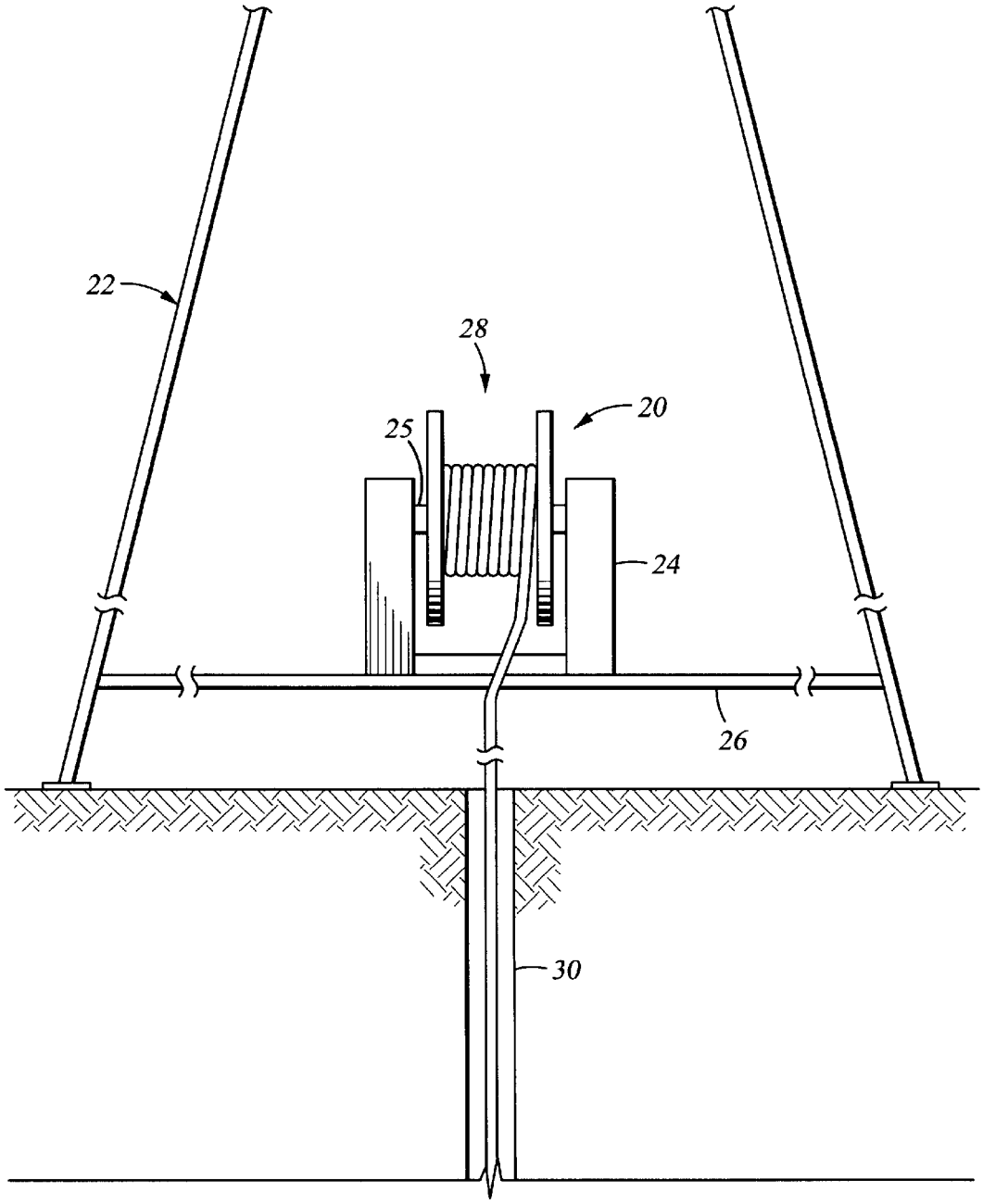
FIG. 1 illustrates an embodiment of the present invention mounted on a drilling rig.

Referring now to FIG. 1, a reel 20 constructed in accordance with the present invention is mounted on a cradle 24 located on a drilling rig 26 at a well site. Reel 20 stores an extended length of composite coiled tubing 28 that is run into a well bore 30. Tubulars made of composites are discussed in pending application Ser. No. 09/081,961 filed May 20, 1998, titled "Well System," which is hereby incorporated by reference for all purposes. Preferred embodiments of reel 20 that may be adapted to various well sites are described below.

Figure 2:
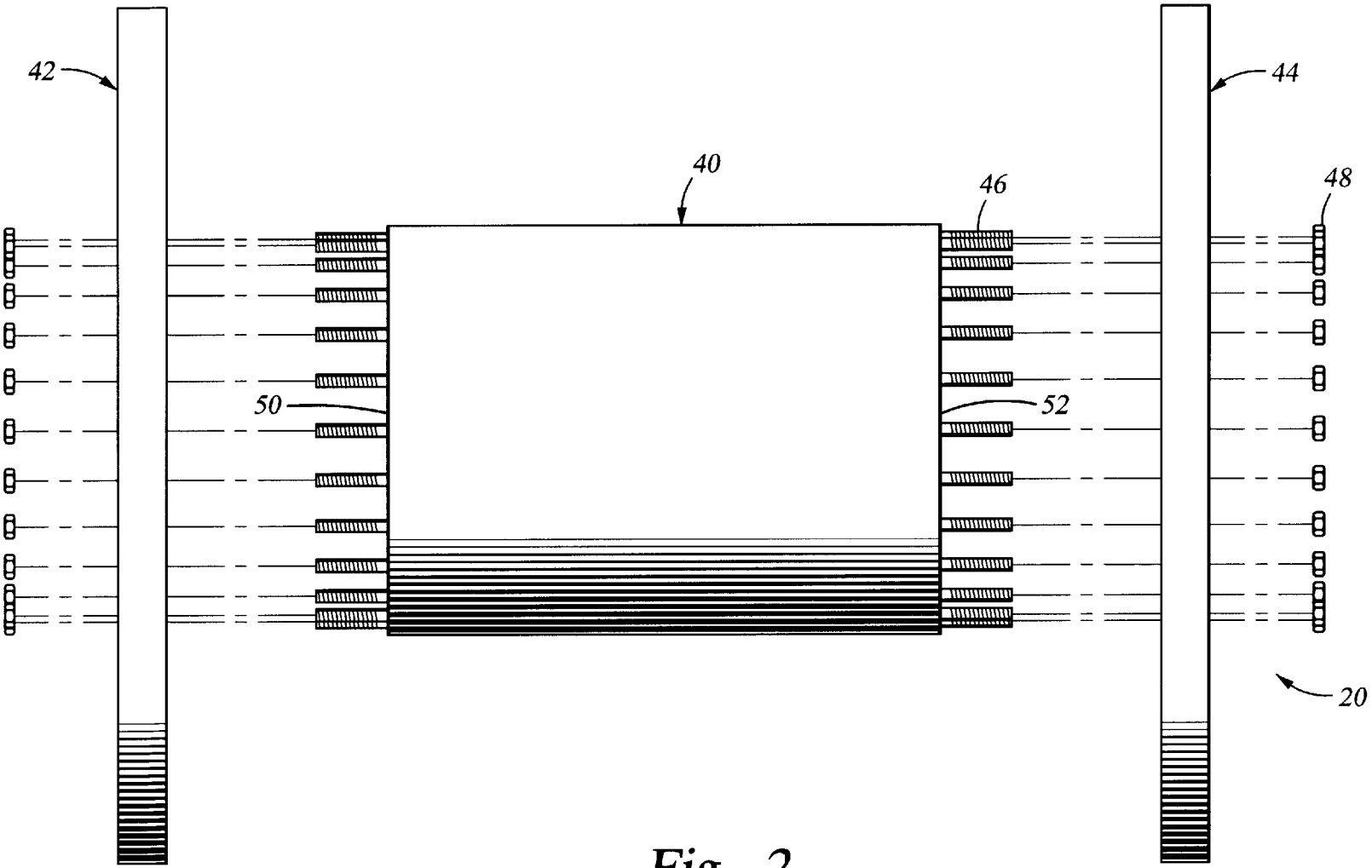
FIG. 2 is an exploded view of one embodiment of a coiled tubing spool constructed in accordance with the present invention.

Referring now to FIG. 2, a preferred embodiment of reel 20 includes a drum 40, a first sidewall 42, a second sidewall 44, threaded studs 46, and nuts 48. Threaded studs 46 are preferably circumferentially arrayed on end faces 50, 52 of drum 40.

Figure 3:
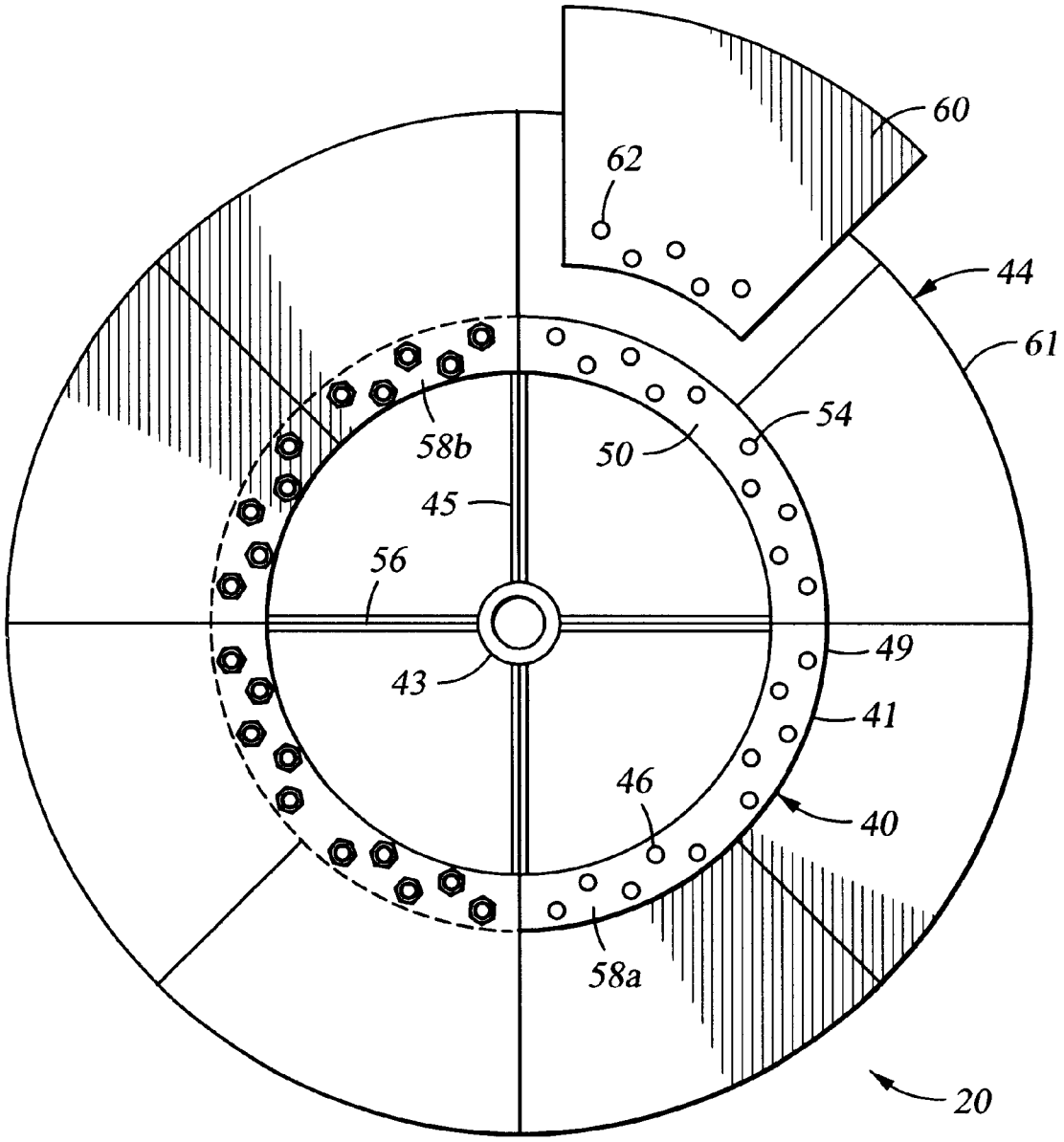
FIG. 3 is an end view of an embodiment of the present invention, showing one-half of one side wall removed.
Figure 3A:
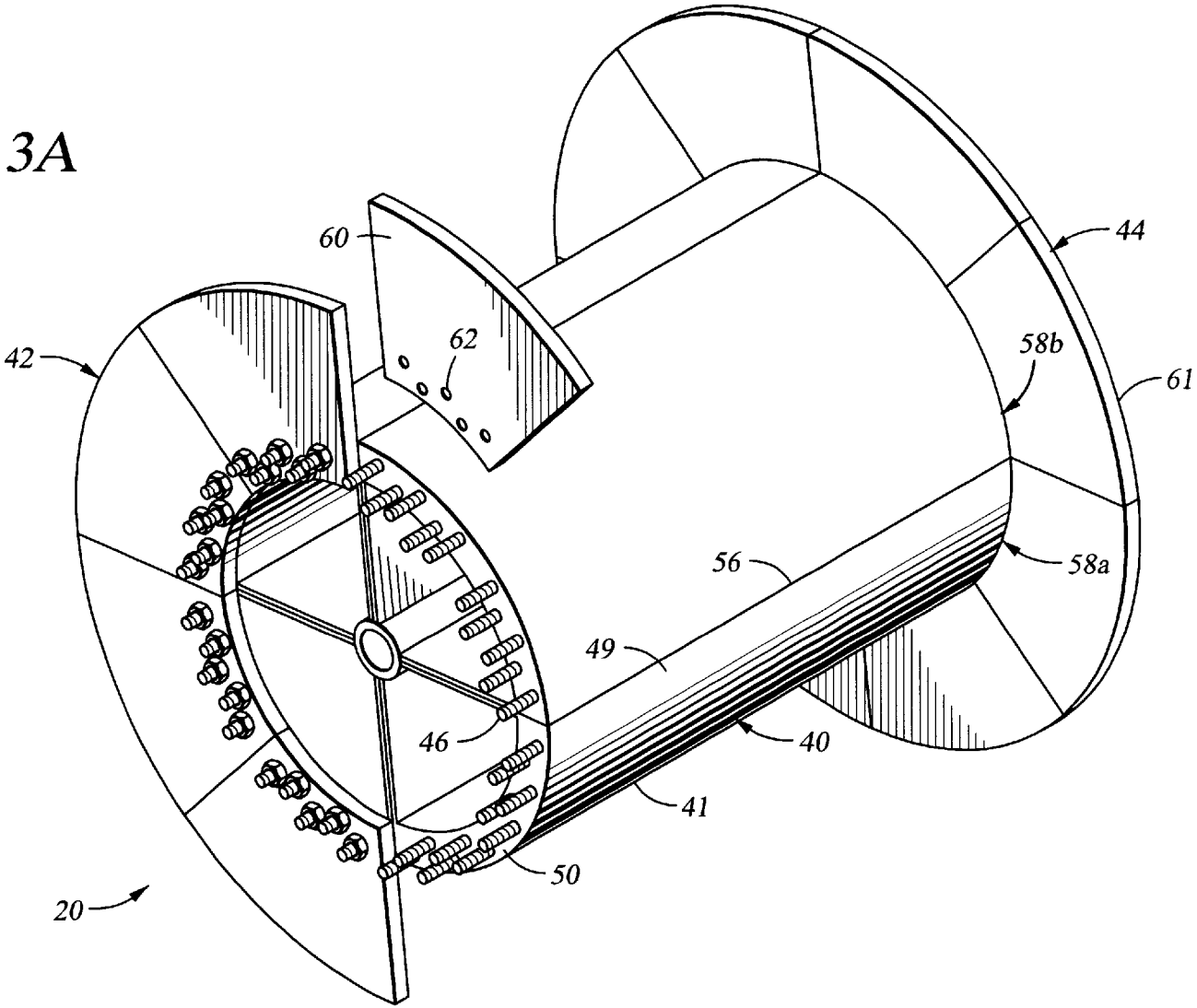
FIG. 3*a* is an isometric view of the embodiment of FIG. 3.
Figure 3B:
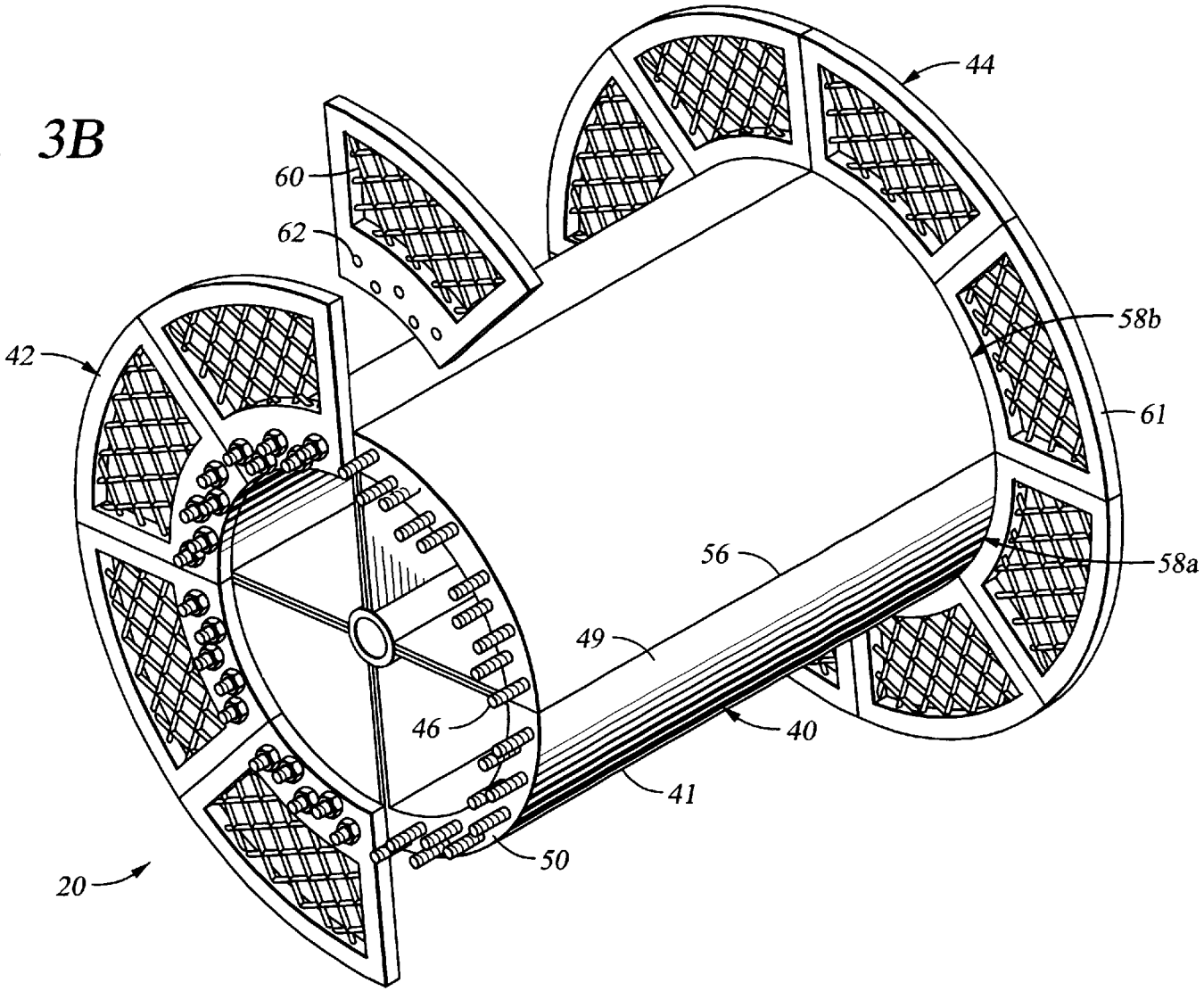
FIG. 3*b* is an isometric view of the embodiment of FIG. 3 with reinforced wire mesh sidewalls.

First and second sidewalls 42, 44 retain the composite coiled tubing that may be spooled onto hub 42. Because first and second sidewalls 42, 44 are substantially identical, only first sidewall 42 will be described in detail herein. Referring now to FIGS. 3 and 3*a*, first sidewall 42 preferably comprises a plurality of sectional flanges 60 contiguously disposed on first drum face 50. According to a preferred embodiment, flanges 60 include clearance holes 62 arranged to receive threaded studs 46. A similar arrangement is provided for flanges 61 of second sidewall 44. It will be understood that any number of releasable locking arrangements may be used to secure flanges 60 to drum 40. For example, clamps (not shown) adapted to releasably receive flanges 60 may be provided on drum 40.

It is known that composite coiled tubing spooled onto drum 40 does not impose significant loading along the axis of drum 40. Accordingly, flanges 60 may be designed with an emphasis on minimizing shipping and handling difficulties. For example, flanges 60 may be formed as thin lightweight steel plates or as walls of reinforced wire mesh to reduce weight. Additionally, flanges may include perforations or be arranged in a non-contiguous fashion for further reductions in size and weight. Indeed, nearly any structure retains the coiled tubing on drum 40, such as radially disposed bars (not shown), may also be used.

Drum 40 supports the composite coiled tubing spooled onto and payed out from reel 20. Cradle 24 (FIG. 1) rotates drum 40 via an interconnecting axle 25. Still referring to FIGS. 3 and 3*a*, drum 40 includes a hub 41, a centerpiece 43, and a plurality of spokes 45. Hub 41 is concentrically supported on centerpiece 43 by outwardly radiating spokes 45. Hub 41 presents a winding surface 49 on which composite coil tubing seats. Arrangements for the winding surface are disclosed in commonly-owned U.S. application Ser. No. 09/443,407 entitled Reel for Supporting Composite Coiled Tubing, which is hereby incorporated by reference for all purposes. Lifting eyes (not shown) may be provided to facilitate shipment and manipulation of drum 40.

Preferably, the diameter of hub 41 is selected to introduce a strain of 2% or less in the composite coiled tubing. Thus, for composite coiled tubing having a diameter of 2⅞ inches, the diameter of hub 41 should be approximately 144 inches or greater. Similarly, for composite coiled tubing having a diameter of 3⅞ inches, the hub diameter should be approximately 194 inches or greater. It is expected that a hub diameter selected in accordance with the stated criteria will optimize the operating life of the composite coiled tubing. However, it should be understood that advances in composite materials may allow hub diameters that introduce strains of greater than 2% into the composite coiled tubing.

The several elements of drum 40 are preferably fabricated separately and can be assembled by standard welding procedures, threaded fasteners or any other suitable means. Preferably, drum 40 is formed to be shipped as a single unit. However, if the fabricated diameter of hub 40 is not within permissible transportation limitations, an axle split line 56 be used to break drum 40 into mating semicylindrical halves 58*a,b*. Mating semicylindrial halves 58*a,b* can be joined using a variety of known methods, such as threaded fasteners (not shown). The use of additional splitlines will further reduce the size and weight of the individual sections that make up drum 40. Furthermore, the joining method may take advantage of the operational characteristics of composite coiled tubing. For example, when pressurized drilling fluid is pumped into a well via composite coiled tubing, the portion of composite coiled tubing spooled on a reel tends to expand radially. This radial expansion results in a compressive force on hub 40 that may assist in maintaining the structural integrity of drum 40 that incorporates splitlines.

Figure 4:
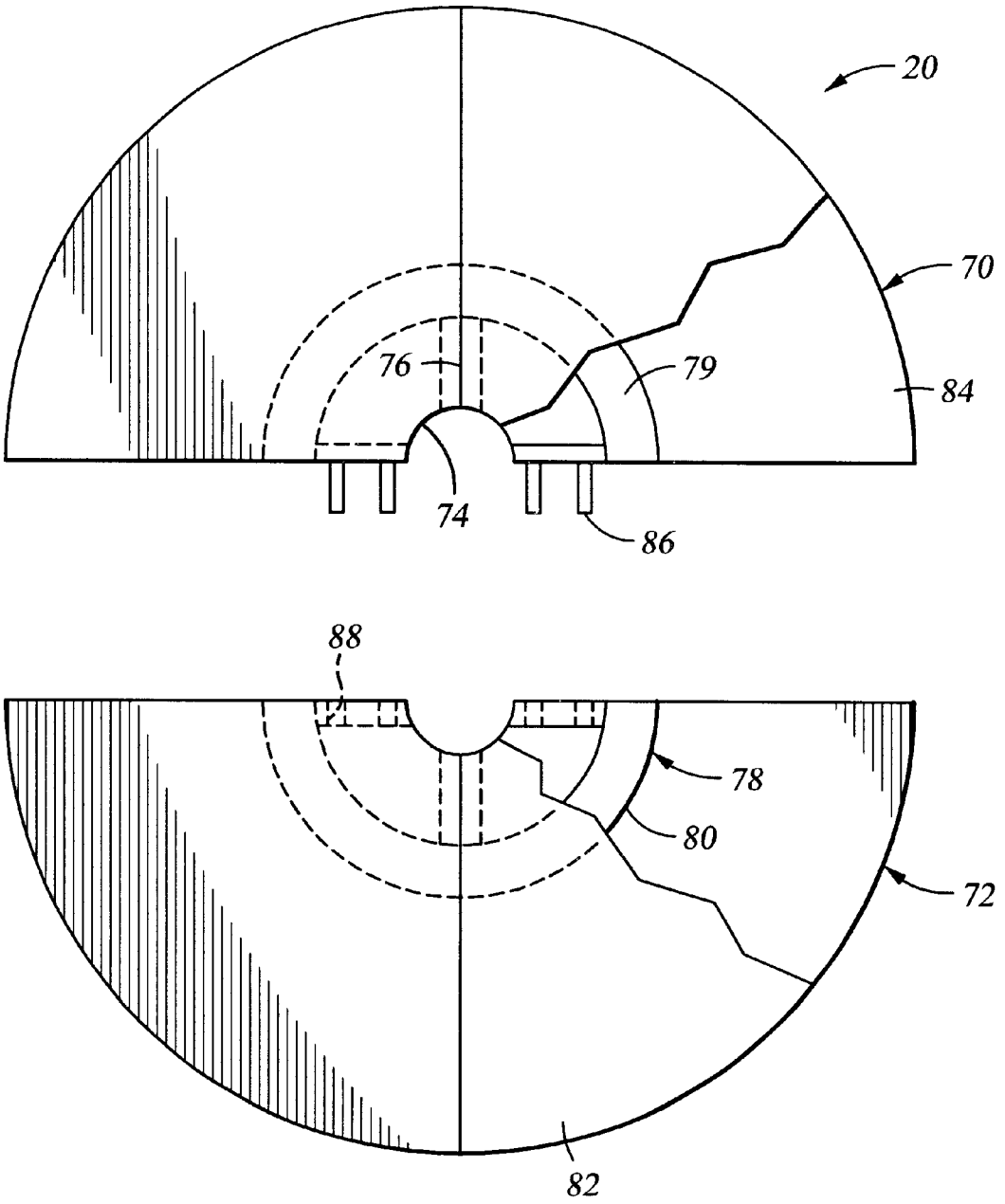
FIG. 4 is and end view of another embodiment of the present invention.

Referring now to FIG. 4, another embodiment of reel 20 includes mating first and second portions 70, 72. Because first and second reel portions 70, 72 are substantially symmetrical, only first reel portion 70 will be described. First reel portion 70 is preferably formed as a single unit having a centerpiece 74 having outwardly radiating spokes 76 that support a hub 78. Hub 78 provides a winding surface 80 for seating the composite coiled tubing. Sidewalls 82, 84 are fixed on hub end faces 79. It will be appreciated that the unitary design of first reel portion 70 allows the use of numerous fabrication methods such as fillet welds, threaded fasteners, interlocking members, or combinations thereof To join first reel portion 70 to second reel portion 72, a plurality of threaded studs 86 may be provided on spokes 76 of first portion 70. Clearance holes 88 on second reel portion 72 are adapted to receive threaded studs 86. Nuts (not shown) threaded onto threaded studs 86 secure first reel portion 70 to second reel portion 72. It should be understood that first and second reel portions 70, 72 may be assembled by any suitable number of method and the described use of threaded studs is merely exemplary. Furthermore, it will be understood that reel 20 may be divided into more that two segments. Thus, acceptable arrangements of preferred reel 20 may include three or more portions that are readily releasable and engagable.

For 1500 meters of composite coiled tubing having 2⅞ inch gage, an exemplary reel may have a hub diameter of twelve feet and an overall diameter of eighteen feet. An exemplary disassembly arrangement may include first and second sidewalls that comprise eight flanges each. Such a disassembly arrangement would provide flanges with a maximum width of approximately seven feet and a drum diameter of twelve feet. Thus, the maximum dimension of any component to be transported is reduced from eighteen feet to twelve feet. The sidewall may be formed from more or fewer flanges. Additionally, a split line may be used to further reduce the size and weight of the drum. For composite coiled tubing having gages of 3½ inches, 4½ inches or greater, coiled tubing lengths of 1500 meters would necessitate larger reels. However, such reels would nonetheless breakdown into readily transportable components if designed in accordance with the present invention.

The above described embodiments of the present invention may be used for a well completion or workover operation where the well operator intends to use an extended length of composite coiled tubing. While the composite coiled tubing may be shipped on several separate spools and interconnected during injection into a well bore, a well operator may opt to utilize a single reel for subsequent composite coiled tubing handling.

Typically, a well operator selecting a reel in accordance with the present invention will employ a two-step process to arrive at an optimal design for a reel. The first step is to establish overall design dimensions of the reel with respect to the configuration of coiled tubing to be used. Usually, the overall dimensions of the reel are dictated by the required storege capacity, i.e., the length and gage of composite coiled tubing to be spooled, and the expected static and operational loads. The second step is to establish a disassembly design that facilitates the transportation and handling of the required reel. The disassembly configuration of the reel for a given well site is dictated by factors such as shipping costs, size restrictions along transport routes, the capacity of storage facilities at a well site, applicable safety regulations, and the weight limitations on lifting equipment such as cranes and cables.

Once the design has been established for the several components of the reel (hereinafter the master reel), the master reel components may be fabricated and shipped to the well site. Relatively short lengths of composite coiled tubing are delivered to the well site on small individual reels. During well operations, the short lengths of composite coiled tubing are made-up as required and sequentially injected into a well bore. Arrangements for such an operation are discussed in pending application Ser. No. 09/081, 961 titled "Well System." When operations require that the entire extended length of composite coiled tubing be tripped out of the well bore, the master reel is assembled and installed on a suitable platform. After establishing the appropriate connections, the entire extended length of composite coiled tubing may be spooled onto the master reel. It is contemplated that more than one master reel may be utilized during the spooling/retrieval process. The actual number of master reels, of course, depends on the length of the composite coiled tubing injected into the well. Thus, an extended length of tubing may be readily retrieved and deployed without having to spool the extended length of tubing onto several small reels.

It can be seen that once the present reel is loaded with the extended length of composite coiled tubing at a well site, the reel may be readily transported to other well sites in the vicinity. Moreover, if the reel is housed on a ship, the reel may be transported to nearly any offshore well. Thus, for well servicing operations subsequent to the initial operation, a reel made in accordance with the present invention reduces or even eliminates reel change-outs during both the injection and retrieval phases.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Furthermore, where methods have been described, it should be understood that the individual steps of the methods may be executed in any order, unless a specific order is expressly prescribed. Accordingly, the scope of protection is not limited to the embodiments described herein, but is only limited by the claims which follow, the scope of which shall include all equivalents of the subject matter of the claims.

What is claimed is:

1. A reel assembly for supporting composite coiled tubing, comprising:

a drum having first and second end faces; and first and second sidewalls removably mounted on said end faces wherein said sidewalls are formed of reinforced wire mesh.

2. A reel assembly for supporting composite coiled tubing, comprising:

a drum having an axle splitline defining first and second portions, said first portion releasably connected to said second portion, said first and second portions each having first and second end faces;

a first flange mounted on said first portion first end face;

a second flange mounted on said second portion first end face;

a third flange mounted on said first portion second end face; and a fourth flange mounted on said second portion second end face.

3. The reel assembly of claim 2 wherein said drum has a diameter that induces a strain of less than approximately 2% in the composite coiled tubing when the composite coiled tubing is wound on said drum.

4. The reel assembly of claim 3 wherein said drum and said flanges are configured to store at least 1,500 meters of composite coiled tubing.

5. The reel assembly of claim 2 wherein said drum is formed of light weight high strength steel.

6. The reel assembly of claim 2 wherein said flanges are formed of reinforced wire mesh.

7. The reel assembly of claim 3 further comprising a plurality of threaded fasteners and associated nuts securing said drum first portion to said drum second portion.

8. A method of storing composite coiled tubing at a well site, comprising:

(a) transporting a first length of composite tubing to the well site;

(b) transporting a second length of composite tubing to the well site;

(c) providing a master reel having the capacity to store at least the combined lengths of the first and second lengths of composite tubing, the master reel comprising at least two sections releasably fastened together; and (d) spooling the first and second lengths of composite tubing onto the master reel.

9. The method of claim 8 further comprising transporting the master reel to a second well site.

10. A method of deploying composite coiled tubing at a well site, comprising:

injecting a first length of composite coiled tubing into a well bore;

connecting a second length of composite coiled tubing to the first length of composite coiled tubing so as to form an extended length of coiled tubing;

injecting the second length of composite coiled tubing into the well bore;

providing a master reel at the well site; and spooling the extended length of composite coiled tubing onto the master reel.

11. The method of claim 10, further comprising transporting the master reel to a second well site.

12. A method of servicing a well using composite coiled tubing, the method comprising:

transporting a plurality of individual lengths of composite coiled tubing to a well site;

making up a working string by interconnecting the plurality of lengths of composite coiled tubing, the working string having a free end and a coupling end;

mounting a down hole implement on the free end of the working string;

injecting the working string into a well bore; and retrieving the working string by spooling the working string onto at least one master reel having a capacity greater than the longest individual length of coiled tubing at the well.

13. The method of claim 12 wherein the downhole implement is a bottom hole assembly adapted to drill through formation.

14. The method of claim 12 wherein the working string is at least 20,000 feet in length.

15. The method of claim 12 further comprising selecting a composite coiled tubing material that has a substantially neutral buoyancy in drilling fluid.

16. The method of claim 15, further comprising transporting the master reel to a second well site.

17. The method of claim 16 wherein the downhole implement is a package of sensors configured to read formation characteristics.

* * * * *

UNITED STATES PATENT AND TRADEMARK OFFICE

CERTIFICATE OF CORRECTION

PATENT NO. : 6,352,216 B1
DATED : March 5, 2002
INVENTOR(S) : Coats

It is certified that error appears in the above-identified patent and that said Letters Patent is hereby corrected as shown below:

Title page,
Item [56], References Cited, U.S. PATENT DOCUMENTS, the following should be added:

| | | | |
|---|---|---|---|
| -- 1,307,526 | 6/1919 | Tuttle | 242/608.4 |
| 2,058,150 | 10/1936 | Hayward et al. | 242/609.2 |
| 3,559,905 | 2/1971 | Palynchuk | 242/407.1 |
| 4,063,691 | 12/1977 | Bacvarov | 242/613.3 |
| 4,895,316 | 1/1990 | Salloum | 242/608.4 |
| 5,242,129 | 9/1993 | Bailey et al. | 242/614.1 |
| 5,285,204 | 2/1994 | Sas-Jaworsky. | 175/40 |
| 5,605,305 | 2/1997 | Picton | 242/608.4 |
| 5,735,482 | 4/1998 | Kuzik | 242/613.3 |
| 5,823,267 | 10/1998 | Burge et al. | 166/385 |
| 5,839,514 | 11/1998 | Gipson | 166/384 |
| 6,065,540 | 5/2000 | Thomeer er al. | 166/77.2 -- |

Signed and Sealed this

Twenty-third Day of March, 2004

JON W. DUDAS
*Acting Director of the United States Patent and Trademark Office*